US012728327B1

(12) United States Patent
Chuong

(10) Patent No.: US 12,728,327 B1
(45) Date of Patent: Sep. 8, 2026

(54) INFLATABLE PADDLES

(71) Applicant: Nathan Chuong, Houston, TX (US)

(72) Inventor: Nathan Chuong, Houston, TX (US)

(73) Assignee: Nathan Chuong, Houston, TX (US)

( * ) Notice: Subject to any disclaimer, the term of this patent is extended or adjusted under 35 U.S.C. 154(b) by 0 days.

(21) Appl. No.: 19/020,691

(22) Filed: Jan. 14, 2025

Related U.S. Application Data

(60) Provisional application No. 63/553,084, filed on Feb. 13, 2024.

(51) Int. Cl.
*A63B 59/42* (2015.01)
*A63B 60/06* (2015.01)

(52) U.S. Cl.
CPC ..... *A63B 59/42* (2015.10); *A63B 60/06* (2015.10); *A63B 2225/62* (2013.01)

(58) Field of Classification Search
CPC ..... A63B 59/04; A63B 60/00; A63B 2225/06
See application file for complete search history.

(56) References Cited

U.S. PATENT DOCUMENTS 3,162,443 A * 12/1964 Petri ..... A63B 60/08 273/DIG. 8
4,189,142 A * 2/1980 de Vries ..... A63B 51/06 473/542
4,206,917 A * 6/1980 Guillem ..... A63B 60/54 473/534
4,635,936 A * 1/1987 Becker ..... A63B 60/06 473/528
6,053,827 A * 4/2000 MacKay, Jr. ..... A63B 60/10 473/566
6,261,141 B1 * 7/2001 Heap ..... B63H 16/04 440/101
7,458,270 B2 * 12/2008 Kiefer ..... B60S 5/043 73/146
8,663,026 B2 * 3/2014 Blowers ..... A63B 53/08 473/345
9,814,955 B2 * 11/2017 Bonfigli ..... A63B 60/50
2005/0043110 A1 * 2/2005 Lindsey ..... A63B 60/06 473/300
2011/0201461 A1 * 8/2011 Gazzara ..... A63B 60/50 473/527
2016/0339312 A1 * 11/2016 Bonfigli ..... A63B 60/28
2022/0268263 A1 * 8/2022 Liang ..... F04B 33/00

* cited by examiner

*Primary Examiner* — Garrett K Atkinson

(74) *Attorney, Agent, or Firm* — Miller IP; Devin Miller

(57) ABSTRACT

Described herein are examples of apparatuses which include a paddle. The paddle may comprise a paddle head comprising a surface for striking a ball and an inflatable bladder. The inflatable bladder may be configured to inflate by introducing a gas under pressure or other fill material into the paddle head. The handle may be coupled to the paddle head.

20 Claims, 7 Drawing Sheets

INFLATABLE PADDLES

CROSS-REFERENCE TO RELATED APPLICATIONS

The present application claims the benefit of U.S. Provisional Patent Application No. 63/553,084 entitled "INFLATABLE PADDLE", filed on Feb. 13, 2024. The entire contents of the above-listed application are hereby incorporated by reference for all purposes.

BACKGROUND

In the realm of sports gear, paddles serve as essential tools across a variety of racket sports, providing players with the means to strike a ball during gameplay. These paddles generally consist of a combination of materials, often incorporating frames and specialized surfaces tailored to the requirements of different sports. The design and construction of paddles vary, reflecting the nuances of each sport and the preferences of players. Specifically, in the domain of pickleball, paddles are available in various styles, materials, and forms and provide diverse features that enhance the pickleball playing experience.

BRIEF DESCRIPTION OF THE DRAWINGS

The present description will be understood more fully when viewed in conjunction with the accompanying drawings of various examples of inflatable paddles. The description is not meant to limit the inflatable paddle to the specific examples. Rather, the specific examples depicted and described are provided for explanation and understanding of inflating paddles. Throughout the description the drawings may be referred to as drawings, figures, and/or FIGs.

DETAILED DESCRIPTION

Figure 1:
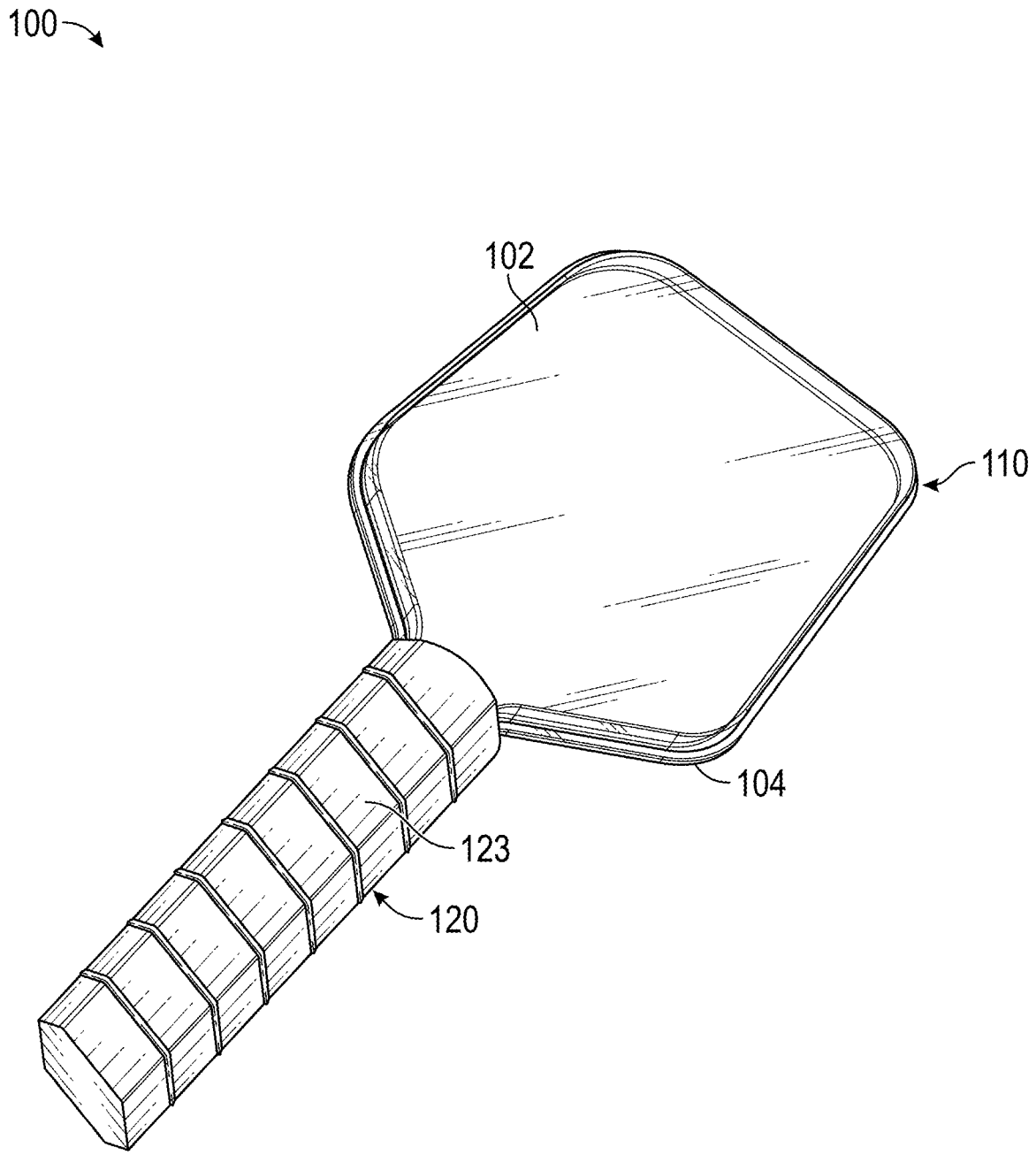
FIG. 1 illustrates a perspective view of a paddle, according to an embodiment.

A paddle as disclosed herein will become better understood through a review of the following detailed description in conjunction with the figures. The detailed description and figures provide merely examples of the various embodiments of paddles. Many variations are contemplated for different applications and design considerations; however, for the sake of brevity and clarity, all the contemplated variations may not be individually described in the following detailed description. Those skilled in the art will understand how the disclosed examples may be varied, modified, and altered and not depart in substance from the scope of the examples described herein.

A conventional paddle for racket sports, such as pickleball or tennis, typically consists of a rigid frame and a solid or stringed surface. For example, the frame of a conventional tennis racket is commonly made of materials like aluminum or graphite, providing stability and strength. Alternatively, a conventional pickleball racket may include a paddle surface usually composed of materials such as graphite, fiberglass, or carbon fiber to enhance performance and durability. Additionally, the conventional core structure of a pickleball paddle may include a honeycomb pattern. The honeycomb configuration features empty cells. The conventional cores may be constructed from various materials, with polymer, aluminum, aramid fiber, and so forth.

However, despite the widespread adoption of conventional paddle designs, there are certain limitations and opportunities for improvement. Issues may include a trade-off between power and control, potential discomfort from vibrations during play, and limited adaptability for different playing styles or game scenarios. Additionally, the weight and construction of conventional paddles can impact a player's maneuverability and responsiveness on the court.

In response to these challenges, implementations of an innovative paddle design may address some or all of the problems associated with conventional paddles. The new design incorporates a structure that leverages advancements in materials science and manufacturing techniques. For instance, a paddle with an inflatable bladder, adjustable firmness, and a surface that effectively absorbs impact could provide a solution. The use of pressurized air within the core of the paddle may contribute to enhanced shot power while maintaining a lightweight profile for agility.

The disclosed embodiment(s) of this innovative paddle design aim to strike a balance between power and control, offering players the flexibility to adjust firmness according to their preferences. By introducing an inflatable bladder and optimizing the construction materials, the disclosed design may address issues related to vibrations, providing a more comfortable playing experience. The adaptability of the paddle to different playing styles, along with its lightweight nature, may contribute to improved gameplay, making it a promising advancement in the realm of racket sports equipment.

FIG. 1 illustrates a perspective view of a paddle 100 for use in pickleball or other paddle sports, such as platform tennis, paddle tennis, or even recreational activities like table tennis, due to its adaptable construction and functionality. The paddle head 110 includes a surface or face that may be soft to the touch, enabling the paddle head 110 to effectively absorb the impact of the ball. In an embodiment, the paddle head 110 may comprise a bumper. The bumper may be configured to minimize its absorption of impact upon ball contact. Accordingly, the paddle structure may be configured without extra trims or protruding bumpers, especially in a blow molding process during manufacturing. According to various embodiments, the paddle 100 may include a paddle head 110 and a handle 120 coupled to the paddle head 110. For purposes of this disclosure, the term "coupled" means directly or indirectly connected. For example, the handle 120 may be integrally formed with the paddle head 110, or the handle 120 can be separated from the paddle head 110 by one or more intermediate coupling components. According to various embodiments, the paddle 100 may include a paddle head 110 and a handle 120 attached to the paddle head 110.

The paddle head 110 includes a first surface 102 and a second surface 104 on the opposite side. Both surfaces (102, 104) can be used to strike a ball, such as a pickleball or similar objects. Each surface may flex upon contact with the ball, allowing the paddle head 110 to effectively absorb the impact when a player makes a soft touch to move the ball a short distance, yet remain sufficiently firm for striking the ball long distances, such as with cross-court shots or the like.

In an embodiment, the first surface 102 and the second surface 104 may be curved. Alternatively, each surface (102, 104) may be substantially planar. In another embodiment, the first surface 102 may be substantially planar, and the second surface 102 may be curved, or vice versa. In yet another embodiment, a portion of each surface (102, 104) may exhibit a substantially planar profile, while another portion of these surfaces may feature a curved configuration.

The handle 120 may be a longitudinal tubular structure having a distal end and a proximal end. The distal end of the handle 120 may be coupled to the paddle head 110. The handle 120 may include a grip 123 to enhance the ability of a player to grasp, hold, and manipulate the paddle 100. The handle 120 may further include a butt cap (not shown in FIG. 1, see FIG. 6) coupled to the proximal end of the handle 120. In an embodiment, the butt cap may be directly adhesively bonded to the proximal end of the handle 120. In another embodiment, the butt cap may be thermally bonded, mechanically fastened, or otherwise directly attached to the proximal end of the handle 120.

Figure 2:
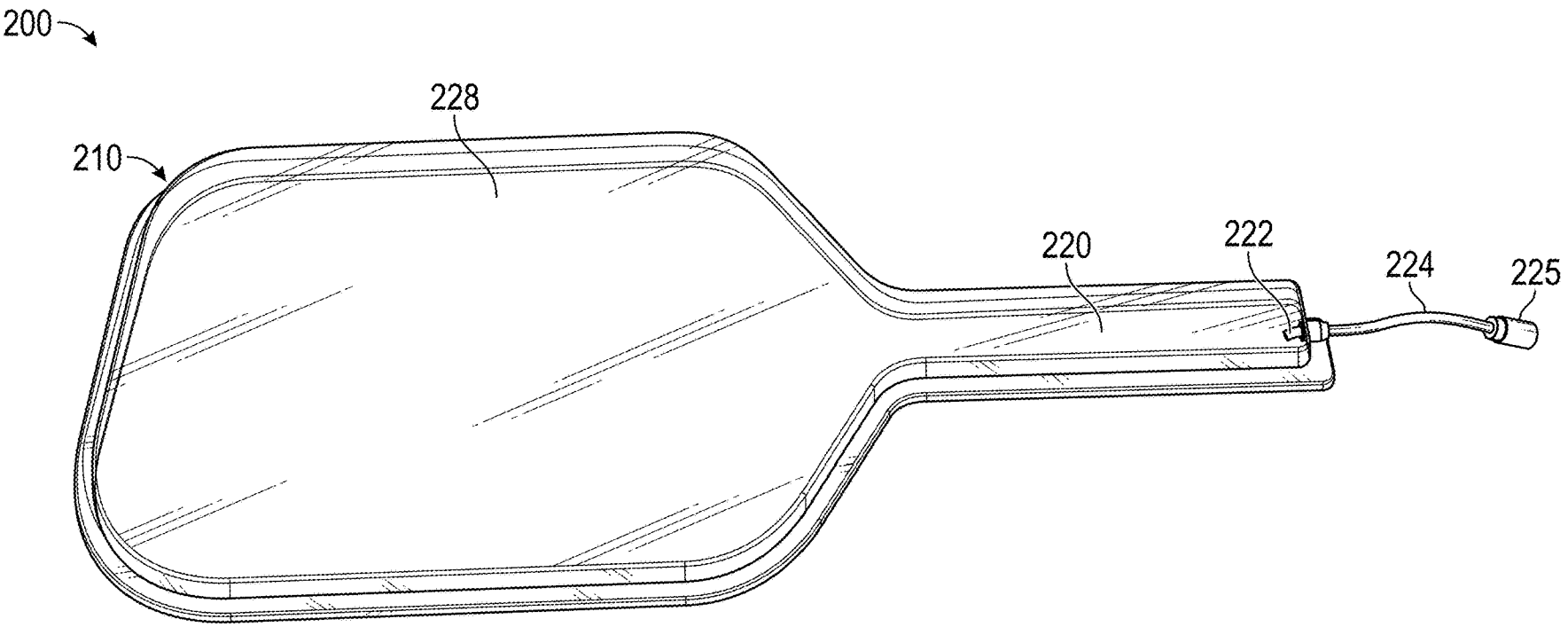
FIG. 2 illustrates a paddle head and handle formed as a unitary paddle, according to an embodiment.

FIG. 2 illustrates a paddle 200 including a paddle head 210 and handle 220 formed as a unitary paddle 200, according to an embodiment. As shown in this figure, in an embodiment, the paddle 200 may be a unitary paddle having a paddle head 210 and a handle 220, where the paddle head 210 and handle 220 form a unitary body and are integrally formed as a single member. The handle 220 may extend from the paddle head 210 and can be configured to be gripped by a person's hand or hands. Embodiments can include the handle 220 with a polygonal cross-sectional shape. In other embodiments, the handle 220 may have a circular, cylindrical or oval cross-sectional shape.

The handle 220 may include an opening 222 at the proximal end configured to receive a fill tube 224 therethrough. The diameter of the opening 222 can be a suitable size to allow the fill tube 224 to fit firmly, forming an effective seal between the outer surface of the fill tube 224 and an inner surface of the opening 222 to prevent air or gas from escaping or entering a bladder 228 within the paddle 200. The fill tube 224 can be coupled to a valve 225, which is, in turn, connected to a pump for inserting air, fluids, foam, other gases and/or other deformable elements through the valve 225, fill tube 224, and into the bladder 228, thereby inflating or filling the bladder 228. The paddle head 210 and handle 220 may share a common passageway, so that air (or other suitable filling elements) can be pumped into the handle 220, flow into the bladder 228 of the paddle 200, and fill and/or inflate both the paddle head 210 and handle 220. The firmness of the paddle 200 may be adjusted by a player by regulating the amount of pressurized gas (or other suitable filling elements) inserted into the bladder 228. In an embodiment, the gas may be air. In another embodiment, the gas may be nitrogen, argon, helium, other suitable gases, or combinations thereof. Nitrogen in particular may advantageously allow the bladder to hold the gas for a longer period despite repeated playtime with the paddle. Liquids, such as water, gels, foams, flowable polymers or other suitable liquids or semi-solid materials can also be employed to fill and/or inflate the bladder 228 and handle 220.

In an embodiment, the valve 225 may be part of or integrated with the bladder 228, similar to the design of a basketball, volleyball, or football where the ball pump valve is integrated and forms a unified structure with the bladder or ball. The valve 225 may be attached and considered an integral part of the bladder 228 and paddle 200, thereby forming a single unit. In an alternate embodiment, a pump can be further integrated into the handle or butt end of the paddle to allow the user/player to adjust the pressure/fill/firmness of the bladder 228. This integrated pump could have a one-way valve or be designed to have a two-way valve allowing for greater or less firmness in the paddle.

The adjustable firmness feature of the paddle 200 provides players with the ability to customize their paddle according to their preferences for striking the ball. By regulating the amount of pressurized gas (or other fill material) inserted into the bladder 228, players can achieve varying levels of firmness in the paddle, tailoring it to their specific playing style. This adjustability is significant as it directly influences the player's control, power, and overall performance on the court. Players seeking a softer touch for delicate shots or short-distance ball movements can reduce the firmness, enhancing their precision and finesse during gameplay. On the other hand, players aiming for more powerful and long-distance strikes may opt for a firmer setting, maximizing the transfer of energy from the paddle to the ball. This adaptability not only caters to individual preferences but also allows players to strategically optimize their equipment based on different game scenarios and opponents. The capacity to fine-tune firmness may enhance and personalize playing experiences across various racket sports.

Pressurized air (or other suitable fill material) within the core of the paddle not only contributes to a structure that facilitates powerful shots and soft touches but also ensures a featherlight design. This combination of firmness, flexibility, and low weight strikes a balance between power and control during use. In racket sports, where rapid reflexes and nimble movements are crucial, the lightweight construction of the paddle becomes a strategic advantage. It enables players to swiftly navigate the court, respond promptly to the trajectory of the ball, and execute rapid shots with enhanced precision. Accordingly, the advantages of a lighter paddle may elevate the player's overall performance.

Figure 3:
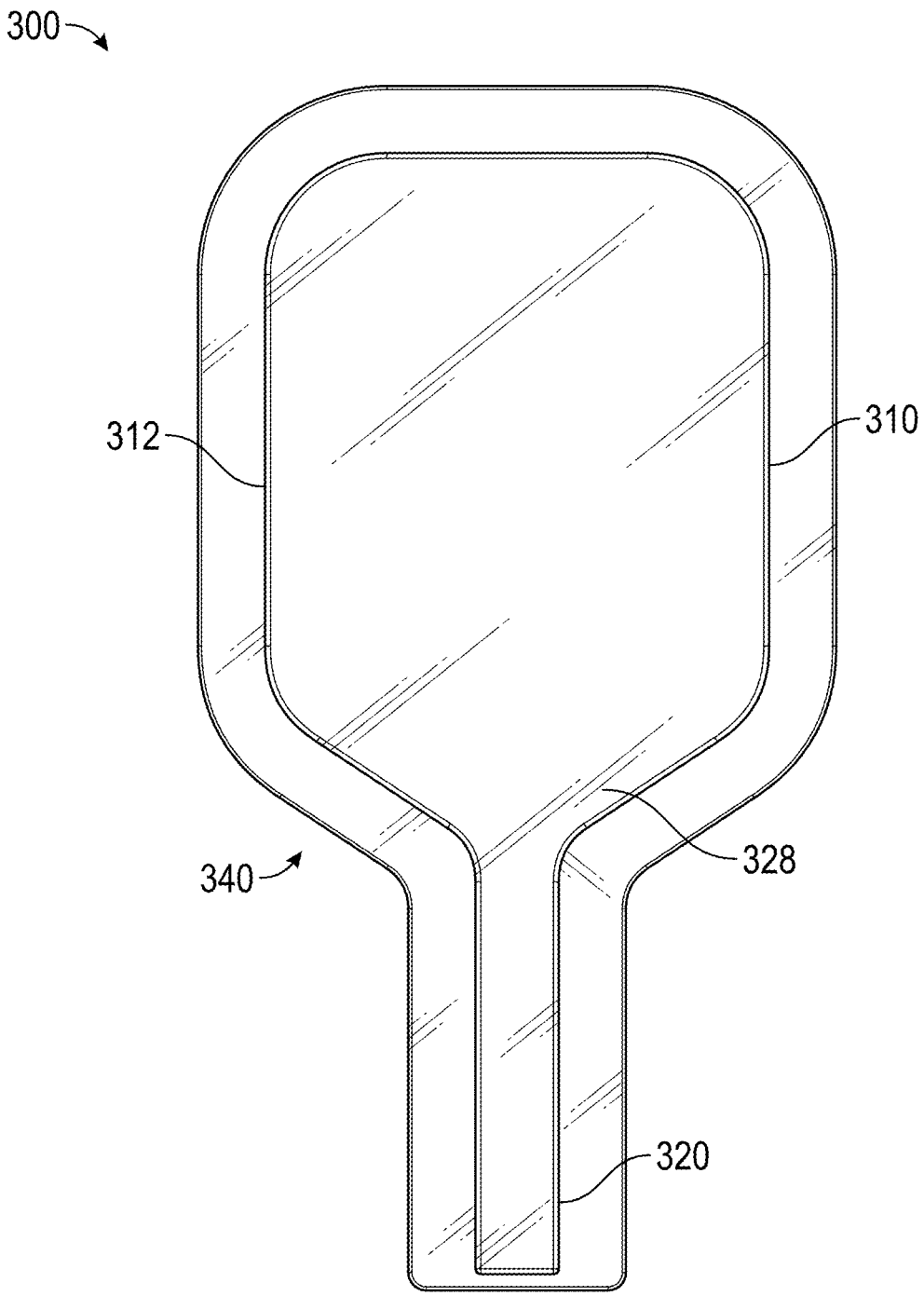
FIG. 3 illustrates a front view of a pre-cut and uninflated paddle assembly, according to an embodiment.

FIG. 3 illustrates a front view of a pre-cut and uninflated paddle assembly 300, illustrating the construction of a paddle 300 with polymer film sheets 340 and formation of the paddle head 310 during the manufacturing process. The paddle assembly 300 can be made of a single material to form an air bladder 328.

In one embodiment, the paddle assembly 300 can be constructed from two polymer film sheets 340*a*, 340*b* that are thermoformed, vacuum-formed, and then welded together via methods such as radio-frequency (RF) welding, ultraviolet (UV) welding, ultrasonic welding, or glueing of the edges. Alternatively, rotational molding (a/k/a rotomolding), multi-layered molding, ultrasonic welding, and injection molding can be used to join the sheets. In this embodiment, the paddle assembly 300 is cut from the polymer film sheets, with the paddle head 310 including a peripheral edge 312. The polymer film sheets 340*a*, 340*b* can be prepared from suitable materials such as thermoplastic, rubber, silicone, and the like. Suitable thermoplastics include polyvinyl chloride (PVC film), polyethylene terephthalate (PET film), thermoplastic polyurethane (TPU film), and similar materials. The two polymer film sheets are joined or fused together and subsequently hermetically sealed to encase the inflatable bladder. The bladder 328 may then be filled with pressurized gas (or other suitable fill material) and sealed. In one example, thermoplastic materials bonded within the bladder 328 wall to wall may prevent bowing and increase the precision of the air distribution inside the bladder 328.

In another embodiment, the paddle assembly 300 can be formed by blow molding using resin beads or carbon fiber instead of polymer sheets. The resin beads or carbon fiber are heated until pliable, then molded to form the paddle assembly shape. Once molded, the paddle assembly 300, including the paddle head 310 with its peripheral edge 312, is cut from the mold. This embodiment offers flexibility in material selection and allows for using a wide range of resins and carbon fiber materials suitable for blow molding.

In another embodiment, the paddle assembly 300 may be constructed from other materials such as HIPS (High Impact Polystyrene), polyethylene, EVA (Ethyl Vinyl Acetate), TPE (thermoplastic elastomers), polycarbonate, acrylic, carbon fiber, or suitable combinations thereof.

The thickness and/or tensile strength of the polymer can be adjusted to provide suitable strength to the surface of the paddle. In embodiments, the paddle surface can have a suitable strength to resist bowing from overinflation/filling of the bladder. Embodiments that include a unitary paddle and bladder, as well as embodiments in which the bladder is enclosed within a separate outer structure (such as in multi-layered molding) can have a sufficient strength to resist bowing. To further aid in resisting bowing, the internal structure of the paddle can be re-enforced to maintain the shape to restrict the paddle from bowing. This can be done via the addition of air, or other fill material under pressure. This can keep the surface of the paddle flat and sturdy, restricting the bladder from becoming compressible when inflated.

Alternative embodiments of the paddle can include multiple bladders or other internal structures within a single paddle. These additional bladders or structures can create distinct "sweet spots" or impact zones on the paddle surface, providing varied responses when striking the ball and enhancing control, precision, and overall play dynamics. By incorporating multiple bladders or tailored internal structures, the paddle offers nuanced play options, allowing users to experience improved performance and responsiveness based on their striking position. These variations enable a customized feel and can enhance the user's experience by adapting to different play styles and preferences.

Additionally, the paddle surface must be resistant to cracking and breaking after extended use. One material of particular interest for this purpose is thermoplastic polyurethane.

In another example, the bladder 328 may include a structure that fills at least a portion of the bladder 328, such as a honeycomb structure, walls, semi-filled structures, and so forth fill at least a portion of the bladder 328. The structure that fills at least a portion of the bladder 328 to adjust, increase, or decrease air distribution within the bladder 328 or a portion of the bladder 328. Embodiments of stringed racket or paddles can have ballers that mimic cylindrical strings in a cross pattern as seen in tennis rackets or racket-ball paddles.

The paddle 300 may be transparent, translucent, or colored. Moreover, it may feature printed designs and covers designed to firmly fit the paddle 300.

Figure 4:
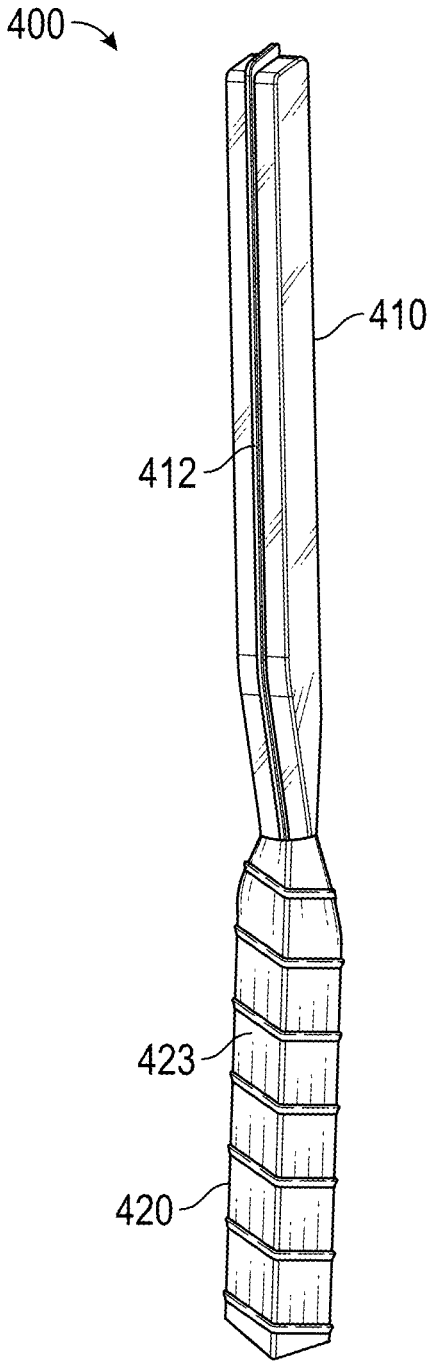
FIG. 4 illustrates a side view of a paddle, according to an embodiment.

FIG. 4 is a side view of a paddle 400, according to an embodiment. In an embodiment, the paddle head 410 can include a peripheral edge 412. The peripheral edge 412 can be bare, i.e., the peripheral edge 412 has no additional covering or material, and is left exposed without any added layers or elements. In another embodiment, the peripheral edge 412 can include an edge strip or bumper (not shown). In an embodiment, the bumper can be formed by joining or fusing two polymer sheets to form the paddle head 410. The bumper may be opaque or translucent. In another embodiment, the bumper may be formed from a thin strip of a polymeric film or tape adhesively bonded to an exterior surface of the paddle head 410. In yet another embodiment, the bumper may be a layer that is coated about the peripheral edge 412 of the paddle head 410. Examples of materials from which the bumper can be formed include, but are not limited to, lightweight materials, nylon, rubber, a thermoplastic material, a thermoset material, wood, and combinations thereof. In another embodiment, the paddle 400 may be formed without a bumper.

In an embodiment, the paddle head as described herein may incorporate an air cushion instead of a bladder. In this configuration, the entire paddle head can be configured in the form of the air cushion. Alternatively, the paddle may be constructed from a rigid material, with the air cushion integrated into it. The air cushion can be positioned at the center or incorporated in a specific area of the paddle head. This adaptable design lets players choose different paddle constructions to suit their preferences in terms of feel, responsiveness, and overall gameplay experience.

Figure 5:
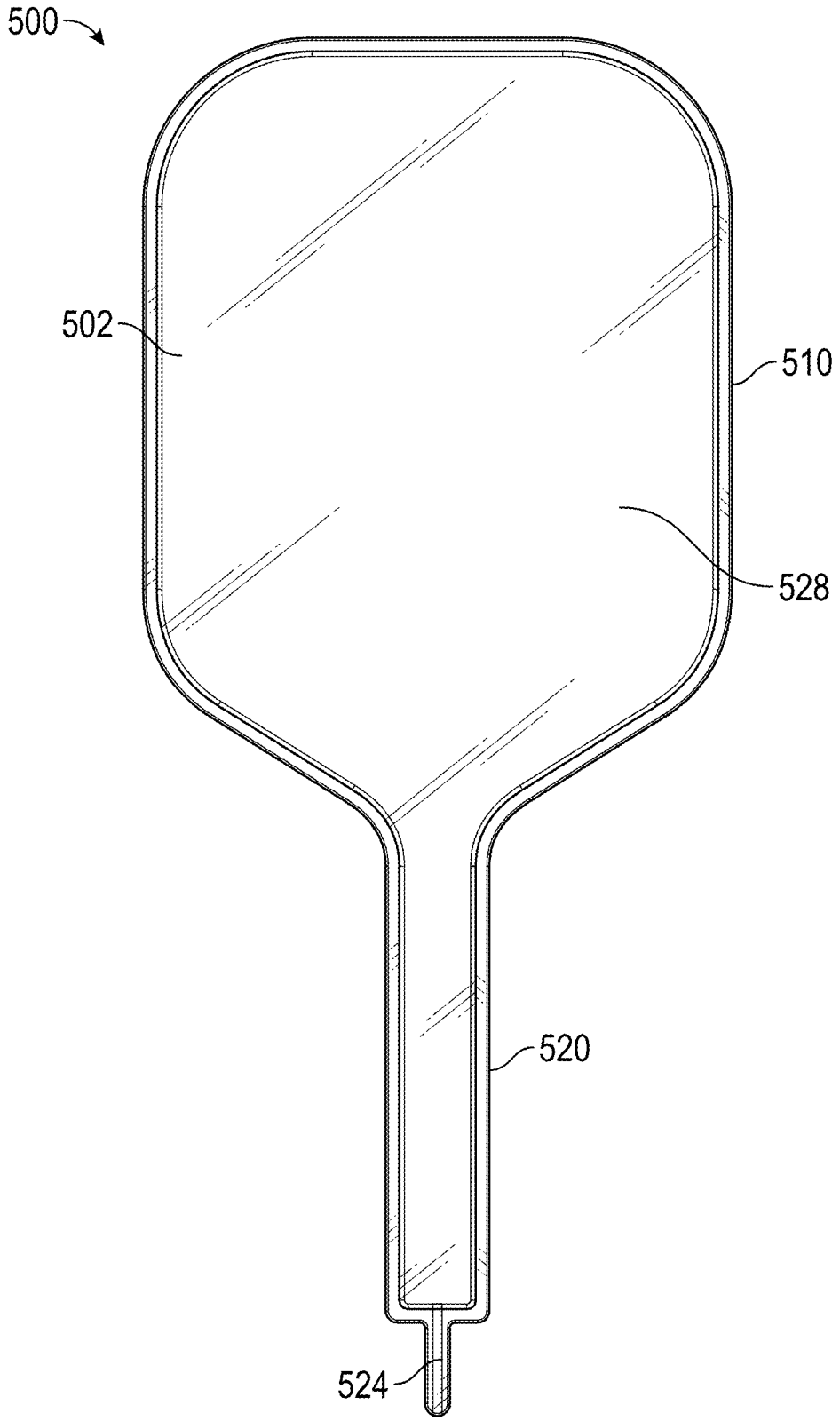
FIG. 5 illustrates a paddle, according to an embodiment.

FIG. 5 illustrates a paddle 500, according to an alternative embodiment. The paddle 500 is a unitary paddle 500 prepared with a paddle head 510 integrated with a paddle handle 520. The bladder 528 is formed via a molding process as described above within the front surface 502 and rear surface 504 (not shown) of the paddle 500. The paddle 500 may be formed to have different or alternative shapes or sizes. A fill tube 524 is shown inserted into the paddle handle 520 to allow air or other suitable fill material to inflate and/or fill the paddle 500.

In an embodiment, the paddle 500 is prepared via blow molding and formed from thermoplastic polyurethane. Other suitable molding processes and/or polymer materials can be employed as described above.

Figure 6:
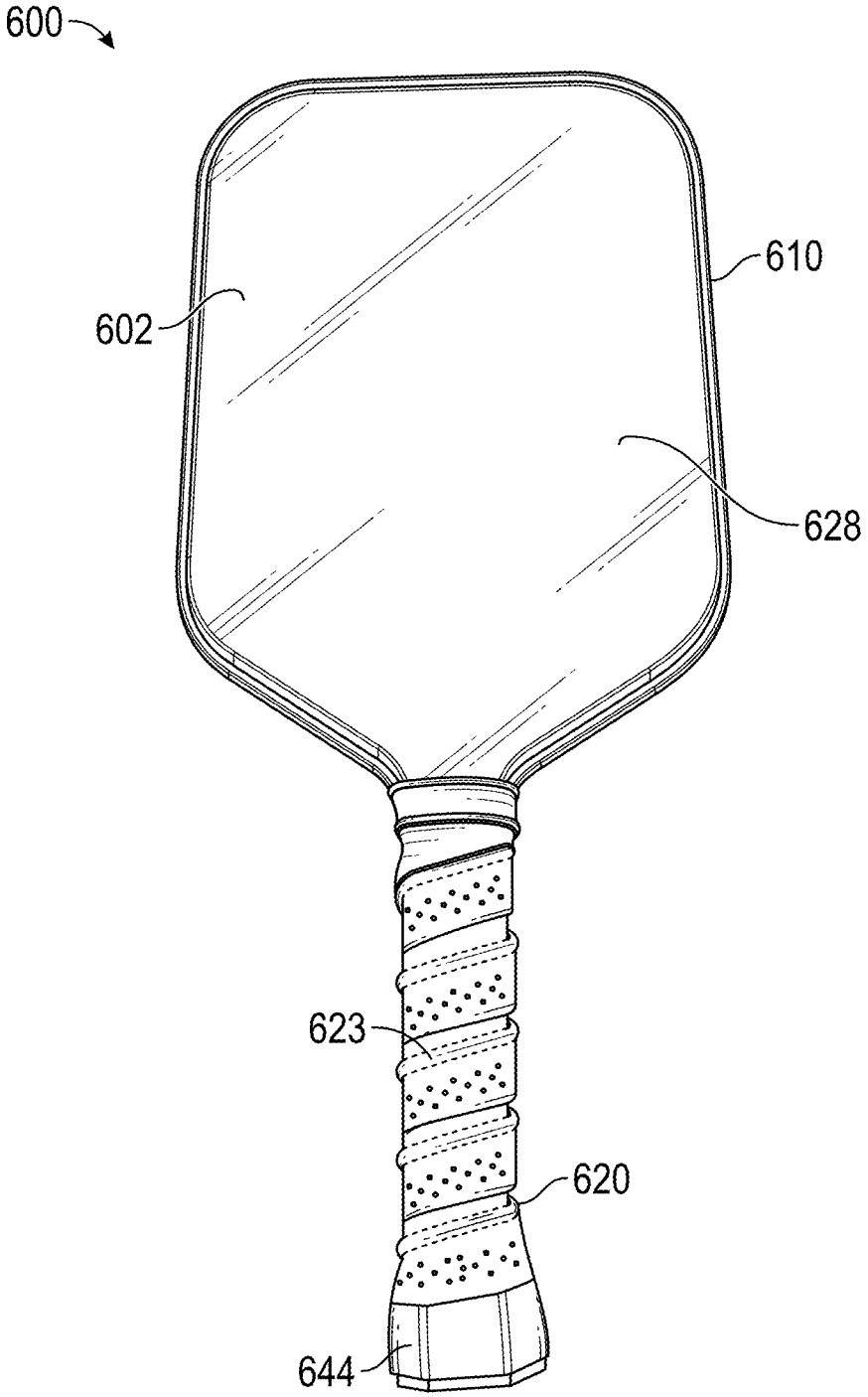
FIG. 6 illustrates a paddle, according to an embodiment.

FIG. 6 illustrates a paddle 600, according to an embodiment. The paddle 600 can be prepared according to the embodiment of FIG. 5 above, and further include a grip 623 and butt cap 644. The grip 623 can be prepared from adhesive tape, leather, polymers, or other suitable material. The grip 623 is configured to allow a player/user to grasp the paddle handle 620 with sufficient friction to avoid slippage due to sweat, humidity, or other environmental or material relevant factors.

The butt cap 644 can be employed to provide an end portion to the distal end of the paddle handle 620. The butt cap 644 assists the player/user by forming a end of the paddle handle 620 with a wider diameter thereby assisting grip and avoiding slippage of the hand of the player off the distal end of the paddle 600.

Embodiments of the butt cap 644 can include a valve 624 (not shown) that allow the player/user to adjust the fill volume of the bladder 628 of the paddle 600. In the illustrated embodiment, the bladder 628 is integrated into the paddle 600 and formed between front surface 602 and rear surface 604 (not shown). Further, the bladder 628 continues into the unitary paddle handle 620. The valve 624 can be a one-way or two-way valve that can allow air of fill material in and/or in and out of the bladder 628. A pump (not shown) can be further integrated into the butt cap 644 to allow the user to adjust the fill volume of the bladder. Alternatively, the user/player can adjust the fill volume of the bladder 628 via an external pump, gas source or other fill material delivery system.

Embodiments can include a device including a paddle including a paddle head including a paddle head first surface, a paddle head second surface, and a paddle head peripheral edge. The device can further including a paddle handle including a paddle handle opening, a fill tube, and a grip, and a butt end. The device can further including a bladder, wherein the paddle head is coupled to the paddle handle, the bladder is positioned between the paddle head first surface and paddle head second surface, the paddle handle opening is distal from the paddle head, the paddle handle opening is configured to allow access to the bladder, the fill tube is configured to be inserted into the paddle handle opening, and the fill tube is further configured to allow fill material to be inserted into the bladder.

Embodiments can include the paddle handle including a valve, and a pump, wherein the valve is coupled to the paddle handle opening and the fill tube, and the pump is coupled to the valve.

Embodiments can include a paddle handle further including a butt end, wherein the butt end is distal to the paddle head, and the diameter of the butt end is greater than the diameter of the paddle handle.

Embodiments can include the pump configured to be activated by manual pressure from a user, and the pump further including a release button configured to release pressure from the bladder.

Embodiments can include a grip prepared from material selected from adhesive tape, leather, polymers and combinations thereof.

Embodiments can include wherein the paddle head and the paddle handle are a unitary construction, and the bladder extends from the paddle head into the paddle handle.

Embodiments can include wherein the bladder is positioned in the paddle head, and the fill tube extends the length of the paddle handle.

Embodiments can include the fill material selected from air, nitrogen, helium, argon, foam, water, semi-solid fluids, polymers, gels, and combinations thereof.

Embodiments can include the paddle formed from a polymer including polyvinyl chloride, polyethylene terephthalate, thermoplastic polyurethane, high impact polystyrene, polyethylene, ethyl vinyl acetate, thermoplastic elastomers, polycarbonates, acrylics, and combinations.

Embodiments can include a paddle including a paddle head including a paddle head first surface, and a paddle head second surface, a paddle handle, a bladder. The paddle further including the paddle head coupled to the paddle handle, the bladder is positioned between the paddle head first surface and paddle head second surface, and the bladder filled with a fill material.

Embodiments can include a valve configured to regulate the firmness of the bladder, and a pump, wherein the pump is configured to be integral with the paddle handle and adjust the firmness of the bladder via manual pressure.

Embodiments can include the bladder prepared as a honeycomb structure configured to allow openings between the paddle head first surface and the paddle head second surface.

Embodiments can include wherein the bladder can be an air cushion internally sealed within the paddle head first surface and the paddle head second surface.

Embodiments can include the paddle head affixed to the paddle handle, and the paddle handle further includes a butt end, wherein the butt end includes a valve configured to allow fill material to enter and exit the bladder, and a manual pump configured to allow a user to regulate the firmness of the paddle head.

Embodiments can include a bladder wherein the bladder is prepared via multi-layering techniques. The bladder can be layered and/or prepared from nylon, graphite, fiberglass, laminations, or other thermoplastic material.

Figure 7:
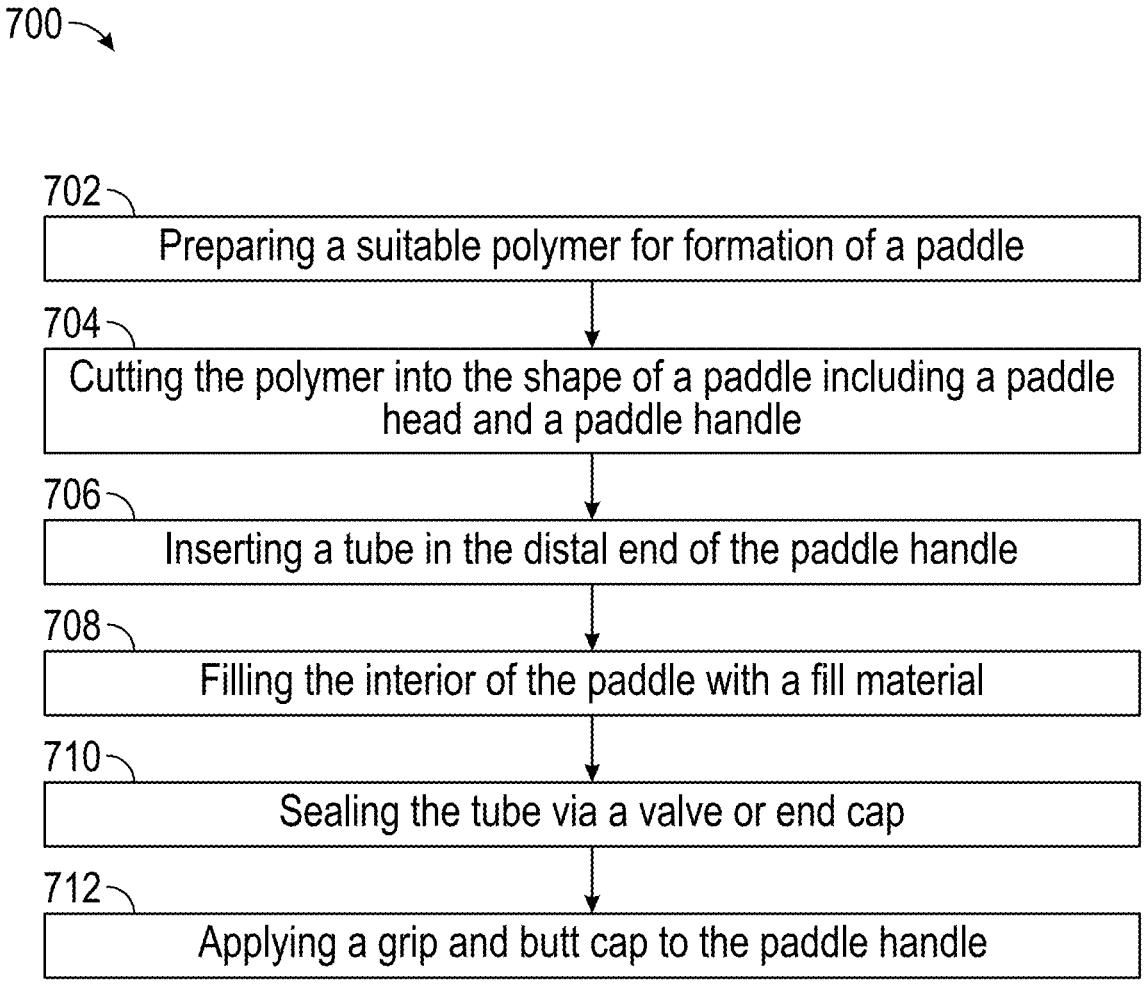
FIG. 7 illustrates a block flow chart of a method, according to an embodiment.

FIG. 7 illustrates a block chart of a method, according to an embodiment. The method of forming a unitary paddle 700 can include the following steps. Step 702 preparing a suitable polymer for formation of a paddle. Step 704 cutting the polymer into the shape of a paddle including a paddle head and a paddle handle. Step 706 inserting a fill tube in the distal end of the paddle handle. Step 708 filling the interior of the paddle with a fill material. Step 710 sealing the fill tube via a valve or end cap. Step 712 applying a grip and butt cap to the paddle handle.

The polymer materials described above, including, but not limited to polyvinyl chloride, polyethylene terephthalate, thermoplastic polyurethane, high impact polystyrene, polyethylene, ethyl vinyl acetate, thermoplastic elastomers, polycarbonates, acrylics, other suitable materials, and combinations thereof can be employed to prepare the paddle according to the present method. Further, the various formation processes described above, including, but not limited to, thermoforming, vacuum-forming, radio-frequency (RF) welding, ultraviolet (UV) welding, ultrasonic welding, rotational molding (a/k/a roto-molding), muti-layered molding, ultrasonic welding, injection molding, or blow molding (and/or blow-fill molding).

Embodiments can include a method of forming a paddle including preparing a suitable polymer for formation of a paddle, cutting the polymer into a shape of a paddle, inserting a fill tube in a distal end of the paddle handle, filling the interior of the paddle with a fill material, sealing the fill tube via a valve or end cap, and applying a grip and butt cap to the paddle handle.

Embodiments can further include the paddle formed via blow molding, and the paddle prepared from thermoplastic polyurethane.

Embodiments can include paddle head formed via muti-layered molding, wherein a bladder can be formed as an interior layer between a paddle head first surface and a paddle head second surface, and a the paddle head first surface and paddle head second surface can be formed as exterior layers.

Embodiments can include the paddle handle affixed to the paddle head, and the fill tube extending the length of the paddle handle from an opening distal to the paddle head to the bladder.

Embodiments can include the paddle handle prepared in a unitary construction with the paddle head, and wherein the bladder extends the length of the paddle handle.

Embodiments can include wherein the paddle can be prepared via a method including thermoforming, vacuum-forming, radio-frequency welding, ultraviolet welding, ultrasonic welding, rotational molding, muti-layered molding, ultrasonic welding, injection molding, blow molding, and combinations thereof.

A feature illustrated in one of the figures may be the same as or similar to a feature illustrated in another of the figures. Similarly, a feature described in connection with one of the figures may be the same as or similar to a feature described in connection with another of the figures. The same or similar features may be noted by the same or similar reference characters unless expressly described otherwise. Additionally, the description of a particular figure may refer to a feature not shown in the particular figure. The feature may be illustrated in and/or further described in connection with another figure.

Elements of processes (i.e. methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. And, an example described using a list of alternatively-inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower or equal in scope to the original claims, are to be considered within the subject matter of the examples described herein.

The invention claimed is:

1. A device, comprising:

a paddle, comprising:

a paddle head comprising:

a paddle head first surface, a paddle head second surface, and a paddle head peripheral edge, a paddle handle comprising:

a paddle handle opening, a fill tube, and
a grip, and
a bladder,
wherein:
the paddle head is coupled to the paddle handle,
the bladder is positioned between the paddle head first surface and paddle head second surface and extends into the paddle handle,
the paddle handle opening is distal from the paddle head,
the paddle handle opening is disposed in fluid communication with the bladder, and
the paddle head and the paddle handle form a unitary body having a common fluid passageway disposed therebetween,
wherein:
a fill material added through the fill tube and into the bladder inflates both the paddle head and the paddle handle.

2. The device of claim 1, wherein the paddle handle further comprises:
a valve, and
a pump,
wherein:
the valve is coupled to the paddle handle opening and the fill tube, and
the pump is coupled to the valve.

3. The device of claim 2, wherein:
the paddle handle further comprises a butt end,
wherein:
the butt end is distal to the paddle head, and
the diameter of the butt end is greater than the diameter of the paddle handle.

4. The device of claim 3, wherein:
the pump is configured to be activated by manual pressure from a user, and
the pump further comprises a release button configured to release pressure from the bladder.

5. The device of claim 1, wherein:
grip is prepared from material selected from the group consisting of:
adhesive tape, leather, polymers and combinations thereof.

6. The device of claim 1, wherein:
the paddle head and the paddle handle are a unitary construction, and
the bladder extends the length of the paddle handle.

7. The device of claim 1, wherein:
the fill tube is disposed in fluid communication with the paddle handle opening.

8. The device of claim 1, wherein:
the fill material is selected from the group consisting of:
air, nitrogen, helium, argon, foam, water, semi-solid fluids, polymers, gels, and combinations thereof.

9. The device of claim 1, wherein the paddle is formed from a polymer selected from the group consisting of polyvinyl chloride, polyethylene terephthalate, thermoplastic polyurethane, high impact polystyrene, polyethylene, ethyl vinyl acetate, thermoplastic elastomers, polycarbonates, acrylics, and combinations.

10. The device of claim 1, wherein:
the paddle is formed via blow molding, and
the paddle is prepared from thermoplastic polyurethane.

11. The device of claim 10, wherein:
the paddle is prepared via a method selected from group consisting of:
thermoforming, vacuum-forming, radio-frequency welding, ultraviolet welding,
ultrasonic welding, rotational molding, muti-layered molding, ultrasonic welding,
injection molding, blow molding, and combinations thereof.

12. The device of claim 1, wherein:
paddle head is formed via muti-layered molding, wherein:
a bladder is formed as an interior layer between a paddle head first surface and a paddle head second surface, and
the paddle head first surface and paddle head second surface are formed as exterior layers.

13. The device of claim 12, wherein:
the fill tube is disposed in fluid communication with the paddle handle opening.

14. The device of claim 12, wherein:
the paddle handle is a unitary construction with the paddle head, and
the bladder extends the length of the paddle handle.

15. A device, comprising:
a paddle, comprising:
a paddle head comprising:
a paddle head first surface, and
a paddle head second surface,
a paddle handle,
a bladder,
wherein:
the paddle head is coupled to the paddle handle,
the bladder is positioned between the paddle head first surface and paddle head second surface and extends into the paddle handle, and
the paddle head and the paddle handle form a unitary body,
wherein:
a fill material added into the bladder inflates both the paddle head and the paddle handle.

16. The device of claim 15 further comprising:
a valve configured to regulate the firmness of the bladder, and
a pump, wherein the pump is configured to:
be integral with the paddle handle, and
adjust the firmness of the bladder via manual pressure.

17. The device of claim 15 wherein:
the bladder is a honeycomb structure configured to allow openings between the paddle head first surface and the paddle head second surface.

18. The device of claim 15 wherein:
the bladder is an air cushion internally sealed within the paddle head first surface and the paddle head second surface.

19. The device of claim 15 wherein:
the paddle head is affixed to the paddle handle, and
the paddle handle further comprise a butt end,
wherein the butt end comprises
a valve configured to allow fill material to enter and exit the bladder, and
a manual pump configured to allow a user to regulate the firmness of the paddle head.

20. A device, comprising:
a paddle, comprising:
a paddle head comprising:
a paddle head first surface;
a paddle head second surface; and
a paddle head peripheral edge;
a paddle handle comprising:
a paddle handle opening;

a fill tube;
a grip;
a valve;
a pump; and
a butt end;
a bladder;
wherein:
the paddle head is coupled to the paddle handle;
the bladder:
is formed between the paddle head first surface and the paddle head second surface and
extends from the paddle head into the paddle handle, and comprises:
a honeycomb structure configured to allow openings between the paddle head first surface and the paddle head second surface;
the paddle handle opening:
is distal from the paddle head; and
is disposed in fluid communication with the bladder;
the paddle head and the paddle handle form a unitary body;
the fill tube:
is configured to allow a fill material to be added through the fill tube and into the bladder to inflate both the paddle head and the paddle handle;
the fill material comprises one or more of air, nitrogen, helium, argon, foam, water, a semi-solid fluid, a polymer, or a gel;
the valve is coupled to:
the paddle handle opening; and
the fill tube;
the valve is configured to:
regulate the firmness of the bladder; and
allow the fill material to enter and exit the bladder;
the fill tube is configured to be sealed via a valve closure or an end cap;
the valve is configured to be sealed via the valve closure or the end cap;
the pump:
coupled to the valve;
integral with the paddle handle; and
configured to be activated by manual pressure from a user to adjust the firmness of the bladder;
comprises a release button configured to release pressure from the bladder;
the butt end:
is distal to the paddle head;
has a diameter greater than the diameter of the paddle handle; and
further comprises the valve and the manual pump;
a butt cap affixed to the butt end of the paddle handle;
the grip is:
applied to the paddle handle; and
prepared from a material comprising adhesive tape, leather, or a polymer;
the paddle:
is formed from a suitable polymer cut into a shape of a paddle, wherein the suitable polymer comprises polyvinyl chloride, polyethylene terephthalate, thermoplastic polyurethane, high impact polystyrene, polyethylene, ethyl vinyl acetate, thermoplastic elastomers, polycarbonates, or acrylics;
is formed by blow molding, thermoforming, vacuum forming, radio-frequency welding, ultraviolet welding, ultrasonic welding, rotational molding, multi-layered molding, or injection molding; and
comprises:
the grip applied to the paddle handle; and
the butt cap affixed to the paddle handle.

* * * * *